United States Patent [19]

Light et al.

[11] Patent Number: 5,037,718

[45] Date of Patent: Aug. 6, 1991

[54] THERMALLY ASSISTED METHOD OF TRANSFERRING SMALL ELECTROSTATOGRAPHIC TONER PARTICLES TO A THERMOPLASTIC BEARING RECEIVER

[75] Inventors: William A. Light, Victor; Donald S. Rimai, Webster; Louis J. Sorriero, Rochester, all of N.Y.

[73] Assignee: Eastman Kodak Company, Rochester, N.Y.

[21] Appl. No.: 455,676

[22] Filed: Dec. 22, 1989

[51] Int. Cl.[5] ..... G03G 13/14

[52] U.S. Cl. ..... 430/126

[58] Field of Search ..... 430/126

[56] References Cited

U.S. PATENT DOCUMENTS

| | | | |
|---|---|---|---|
| 4,533,611 | 8/1985 | Winkelmann et al. | 430/119 |
| 4,868,078 | 9/1989 | Sakai et al. | 430/67 |
| 4,927,727 | 5/1990 | Rimai et al. | 430/126 |
| 4,968,578 | 11/1990 | Light et al. | 430/126 |

OTHER PUBLICATIONS

Light et al., U.S. Application 07/345,160, filed 4/28/89, CIP of 07/230,381, filed 8/9/88.

*Primary Examiner*—Marion E. McCamish
*Assistant Examiner*—S. Crossan
*Attorney, Agent, or Firm*—Willard G. Montgomery

[57] ABSTRACT

A method is provided for non-electrostatically transferring dry toner particles which comprise a toner binder and have a particle size of less than 8 micrometers from the surface of an element which has a surface layer comprising a film-forming, electrically insulating polyester or polycarbonate thermoplastic polymeric binder resin matrix and a surface energy of not greater than approximately 47 dynes/cm, preferably from about 40 to 45 dynes/cm, to a receiver which comprises a substrate having a coating of a thermoplastic condensation polymer on a surface of the substrate in which the Tg of the polymer is less than approximately 10° C. above the Tg of the toner binder and the surface energy of the thermoplastic polymer coating is approximately 38 to 43 dynes/cm by contacting the toner particles with the receiver which is heated to a temperature such that the temperature of the thermoplastic polymer coating on the receiver substrate during transfer is at least approximately 5° C. above the Tg of the thermoplastic polymer whereby virtually all of the toner particles are transferred from the surface of the element to the thermoplastic polymer coating on the receiver substrate and the thermoplastic polymer coating is prevented from adhering to the element surface during transfer in the absence of a layer of a release agent on the thermoplastic polymer coating or the element. After transfer, the receiver is separated from the element while the temperature of the thermoplastic polymer coating is maintained above the Tg of the thermoplastic polymer.

The method is particularly well suited for providing images having high resolution and low granularity from very small size toner particles.

16 Claims, No Drawings

THERMALLY ASSISTED METHOD OF TRANSFERRING SMALL ELECTROSTATOGRAPHIC TONER PARTICLES TO A THERMOPLASTIC BEARING RECEIVER

FIELD OF THE INVENTION

This invention relates to an improved method of non-electrostatically transferring dry toner particles which comprise a toner binder and have a particle size of less than 8 micrometers from the surface of an element to a receiver. More particularly, the invention relates to a thermally assisted method of transferring such toner particles where the particles are carried on the surface of an element which has a surface layer comprising a film-forming, electrically insulating polyester or polycarbonate thermoplastic polymeric binder resin matrix and a surface energy of not greater than approximately 47 dynes/cm to a receiver which comprises a substrate having a coating of a thermoplastic condensation polymer on a surface of the substrate in which the Tg of the thermoplastic polymer is less than approximately 10° C. above the Tg of the toner binder and the surface energy of the thermoplastic polymer coating is approximately 38 to 43 dynes/cm by contacting the toner particles with the receiver which is heated to a temperature such that the temperature of the thermoplastic polymer coating during transfer is at least approximately 5° C. above the Tg of the thermoplastic polymer. After transfer, the receiver is immediately separated from the element while the temperature of the thermoplastic polymer coating is maintained at a temperature which is above the Tg of the thermoplastic polymer.

BACKGROUND

In an electrostatographic copy machine, an electrostatic latent image is formed on an element. That image is developed by the application of an oppositely charged toner to the element. The image-forming toner on the element is then transferred to a receiver where it is permanently fixed, typically by heat fusion. The transfer of the toner to the receiver is usually accomplished electrostatically by means of an electrostatic bias between the receiver and the element.

In order to produce copies of very high resolution and low granularity, it is necessary to use toner particles that have a very small particle size, i.e., less than about 8 micrometers. (Particle size herein refers to mean volume weighted diameter as measured by conventional diameter measuring devices such as a Coulter Multisizer, sold by Coulter, Inc. Mean volume weighted diameter is the sum of the mass of each particle times the diameter of a spherical particle of equal mass and density, divided by total particle mass.) However, it has been found that it is very difficult to electrostatically transfer such fine toner particles from the element to the receiver, especially when they are less than 6 micrometers in diameter. That is, fine toner particles frequently do not transfer from the element with reasonable efficiency. Moreover, those particles which do transfer frequently fail to transfer to a position on the receiver that is directly opposite their position on the element, but rather, under the influence of coulombic forces, tend to scatter, thus lowering the resolution of the transferred image and increasing the grain and mottle. Thus, high resolution images of low granularity require very small particles, however, images having high resolution and low granularity have not been attainable using electrostatically assisted transfer.

In order to avoid this problem, it has become necessary to transfer the toner from the element to the receiver by non-electrostatic processes. One such process is the thermally assisted transfer process where the receiver is heated, typically to about 60° to about 90° C., and is pressed against the toner particles on the element. The heated receiver sinters the toner particles causing them to stick to each other and to the receiver thereby effecting the transfer of the toner from the element to the receiver. The element and receiver are then separated and the toner image is fixed, e.g., thermally fused to the receiver. For details, see copending application Ser. No. 230,394, titled "Thermally Assisted Transfer of Small Electrostatographic Toner Particles" filed Aug. 9, 1988.

While the thermally assisted transfer process does transfer very small particles without the scattering that occurs with electrostatic transfer processes, it is sometimes difficult to transfer all of the toner particles by this process. The toner particles that are directly on the element often experience a greater attractive force to the element than they do to the receiver and to other toner particles that are stacked above them, and the heat from the receiver may have diminished to such an extent by the time it reaches the toner particles next to the element that it does not sinter them. As a result, the toner particles that are in contact with the element may not transfer. Attempts to solve this problem by coating the element with a release agent have not proven to be successful because the process tends to wipe the release agent off the element into the developer which degrades both the developer and the development process. Moreover, because the process tends to wipe the release agent off the element, the application of additional release agent to the element is periodically required in order to prevent the toner particles from adhering to the element during transfer.

An alternative approach to removing all of the toner particles from the element is to use a receiver that has been coated with a thermoplastic polymer. During transfer, the toner particles adhere to or become partially or slightly embedded in the thermoplastic polymer coating and are thereby removed from the element. However, it has been found that many thermoplastics that are capable of removing all of the toner particles also tend to adhere to the element. This, of course, not only seriously impairs image quality but it may also damage both the element and the receiver. Moreover, until now, it has not been possible to predict with any degree of certainty which thermoplastic polymers will remove all of the toner particles from the element without sticking to the element during transfer and subsequent separation of the receiver from the element and which ones will not.

In copending U.S. application Ser. No. 345,160, entitled "Method of Non-Electrostatically Transferring Toner" filed Apr. 28, 1989, which is a continuation-in-part in of U.S. application Ser. No. 230,381, entitled "Improved Method of Non-Electrostatically Transferring Toner" filed Aug. 9, 1988, it is disclosed that if such small sized toner particles are transferred to a receiver formed of a substrate or a support which has been coated with a thermoplastic polymer having a layer of a release agent on the thermoplastic polymer coating and the receiver is heated above the Tg of the thermoplastic polymer during transfer, the release agent will prevent the thermoplastic polymer coating from adhering to the element but it will not prevent the toner from transferring to the thermoplastic polymer coating on the receiver and virtually all of the toner will transfer to the receiver. This constitutes a significant advancement in the art because it is now possible not only to obtain the high image quality that was not previously attainable when very small toner particles were transferred electrostatically but, in addition, the problem of incomplete transfer is avoided. In addition, several other advantages are provided by this process. One such advantage is that copies made by this process can be given a more uniform gloss because all of the receiver is coated with a thermoplastic polymer, (which can be made glossy) while, in receivers that are not coated with a thermoplastic polymer, only those portions of the receiver that are covered with toner can be made glossy and the level of gloss varies with the amount of toner. Another advantage of the process is that when the toner is fixed, it is driven more or less intact into the thermoplastic polymer coating rather than being flattened and spread out over the receiver. This also results in a higher resolution image and less grain. Finally, in images made using this process, light tends to reflect from behind the embedded toner particles that are in the thermoplastic layer which causes the light to diffuse more making the image appear less grainy.

For all of the benefits and advantages provided by this process, however, the application of a release agent to the thermoplastic polymer coating on the receiver in order to prevent the thermoplastic polymer coating from adhering to the surface of the element during transfer and subsequent separation of the receiver from the element creates several problems. One such problem is that the release agent tends to transfer to and build up on the element or photoconductor thereby degrading image quality and causing potential damage to both the element and the receiver. Another problem is that the release agent tends to allow the thermoplastic polymer coating to separate from the support or substrate, especially during or after finishing, due to a reduction in the adhesion strength of the thermoplastic polymer coating to the receiver support caused by the tendency of the release agent, which has a lower surface energy than the thermoplastic polymer coating and hence a lesser predilection to adhere to the receiver support than the thermoplastic polymer coating, to migrate through the thermoplastic polymer coating to the interfacial region between the thermoplastic polymer coating and the support and to cause the thermoplastic polymer coating to separate from the support. It has also been found that the release agent reduces the gloss of the finished image. Finally, the addition of a release agent to the thermoplastic polymer coating adds to the overall cost of the process.

Accordingly, it would be desirable to be able to provide a thermally assisted transfer process for transferring dry toner particles having a particle size of less than 8 micrometers from an element to a receiver in which a thermoplastic polymer coated receiver is utilized such that all of the benefits and advantages afforded by the use of a thermoplastic polymer coated receiver in a thermally assisted transfer process are retained, including the transfer of virtually all of the toner particles from the element to the receiver, but one which does not require the use of a coating or layer of a release agent on the thermoplastic polymer coating on the receiver substrate (or the element) in order to prevent the receiver from adhering to the element during transfer and subsequent separation from the element.

In copending U.S. application Ser. No. 455,673, entitled "Thermally Assisted Transfer of Electrostatographic Toner Particles To A Thermoplastic Bearing Substrate", filed 12/22/89, it is disclosed that such fine toner particles can be transferred from the surface of an element to a thermoplastic polymer coated receiver with virtually 100% toner transfer efficiency using the thermally assisted method of transfer in the absence of a layer or a coating of a release agent on the thermoplastic polymer coating on the receiver substrate in order to prevent the thermoplastic polymer coating from sticking or adhering to the element surface during transfer of the toner particles from the surface of the element to the thermoplastic polymer coated receiver and during the subsequent separation of the receiver from the element if (i) the surface layer of the element on which the toner particles are carried and from which they are to be transferred to the receiver comprises a film-forming, electrically insulating polyester or polycarbonate thermoplastic polymeric binder resin matrix and has a surface energy of not more than approximately 47 dynes/cm, preferably from about 40 to 45 dynes/cm; (ii) the thermoplastic polymer coating on the receiver substrate to which the very fine, small toner particles are to be transferred comprises a thermoplastic addition polymer which has a glass transition temperature or Tg which is less than approximately 10° C. above the Tg of the toner binder and the surface energy of the thermoplastic polymer coating on the substrate is approximately 38 to 43 dynes/cm, and (iii) the receiver is heated to a temperature such that the temperature of the thermoplastic polymer coating on the receiver substrate is at least approximately 15° C. above the Tg of the thermoplastic polymer during toner transfer and the temperature of the receiver is maintained at a temperature such that the temperature of the thermoplastic polymer coating is above the Tg of the thermoplastic polymer immediately following transfer during the time when the receiver separates from the element. This was a surprising result since it would not be expected that the thermoplastic polymer coating would selectively adhere only to the toner particles during toner transfer without also adhering to the element surface due to the similarities of the surface energies, as expressed in dynes/cm, of the thermoplastic polymer coating and the element surface since it is empirically known that, in general, surfaces formed of thermoplastic polymeric materials having similar surface energies tend to adhere or stick to one another when they are brought into intimate contact with one another, as in the situation, for example, where the surface of a toner particle bearing element is brought into intimate contact with and pressed against a thermoplastic polymer coated receiver to effect the transfer of the toner particles from the element surface to the surface of the thermoplastic polymer coating.

It has now been found, however, that such fine toner particles can also be transferred from the surface of an element to a thermoplastic polymer coated receiver with virtually 100% toner transfer efficiency using the thermally assisted method of transfer in the absence of a layer or a coating of a release agent on the thermoplastic polymer coating on the receiver substrate when the thermoplastic polymer coating on the receiver substrate is formed of or comprises a thermoplastic condensation polymer, as distinguished from and in contrast to, a thermoplastic addition polymer if (i) the surface layer of the element on which the toner particles are carried and from which they are to be transferred to the receiver comprises a film-forming, electrically insulating polyester or polycarbonate thermoplastic polymeric resin matrix and has a surface energy of not more than approximately 47 dynes/cm (preferably from about 40 to 45 dynes/cm); (ii) the thermoplastic polymer coating on the receiver substrate to which the very fine toner particles are to be transferred is a thermoplastic condensation polymer and has a glass transition temperature or Tg which is less than approximately 10° C. above the Tg of the toner binder, and (iii) the receiver is heated to a temperature such that the temperature of the thermoplastic polymer coating on the receiver substrate is at least 5° C. above the Tg of the thermoplastic polymer during toner transfer and the temperature of the receiver is maintained at a temperature such that the temperature of the thermoplastic polymer coating is above the Tg of the thermoplastic polymer immediately following transfer during the time when the receiver separates from the element. This is an even more surprising discovery or finding because not only would it be unexpected for a thermoplastic polymer coating formed of a thermoplastic condensation polymer to selectively adhere only to such very small, fine toner particles during toner transfer without also adhering to the element surface due to the similarities of the respective surface energies of the thermoplastic polymer coating and the element surface, but also for the additional reason that both the thermoplastic polymer coating and the polymeric binder resin matrix of the surface layer of the element on which the toner particles are carried are composed of thermoplastic condensation polymers which, when pressed into intimate contact with one another during toner transfer, would be expected to adhere or stick to each other due to the molecular interaction between and bonding of the respective coating and element surface materials.

SUMMARY OF THE INVENTION

Thus, the present invention provides a method of non-electrostatically transferring dry toner particles which comprise a toner binder and which have a particle size of less than 8 micrometers from the surface of an element to a receiver. The toner particles are carried on the surface of an element which has a surface layer which comprises a film-forming, electrically insulating polyester or polycarbonate thermoplastic polymeric binder resin matrix and a surface energy of not greater than approximately 47 dynes/cm. The toner particles are thermally transferred to a receiver which comprises a substrate having a coating of a thermoplastic condensation polymer on a surface of the substrate in which the Tg of the thermoplastic polymer is less than approximately 10° C. above the Tg of the toner binder and the surface energy of the thermoplastic polymer coating is approximately 38 to 43 dynes/cm by contacting the toner particles which are carried on the surface of the element with the thermoplastic polymer coating on the receiver and heating the receiver to a temperature such that the temperature of the thermoplastic polymer coating on the receiver substrate during transfer is at least approximately 5° C. above the Tg of the thermoplastic polymer. Following transfer, the receiver is immediately separated from the element while the temperature of the thermoplastic polymer coating is maintained at a temperature which is above the Tg of the thermoplastic polymer.

It has now been found, quite unexpectedly, that by carefully selecting, as the thermoplastic polymer coated receiver, a receiver in which the thermoplastic polymer coating material is a thermoplastic condensation polymer which has a glass transition temperature that is less than approximately 10° C. above the glass transition temperature of the toner binder and the surface energy of the thermoplastic polymer coating is within a range of from approximately 38 to 43 dynes/cm and, as the element on which the toner particles which are to be transferred to the receiver are carried, an element, which has a surface layer which comprises a film-forming, electrically insulating polyester or polycarbonate thermoplastic polymeric binder resin matrix and has a surface energy not exceeding approximately 47 dynes/cm, and further, by heating the receiver to a temperature such that the temperature of the thermoplastic polymer coating on the receiver substrate during transfer is at least approximately 5° C. above the Tg of the thermoplastic polymer, it is possible to transfer such very small, fine toner particles (i.e. toner particles having a particle size of less than 8 micrometers) non-electrostatically from the surface of the element to the thermoplastic coated receiver and to obtain high resolution transferred images which were not previously attainable when such small toner particles were transferred electrostatically while at the same time avoiding the problems of incomplete transfer and adherence of the thermoplastic polymer coating to the element during toner transfer in the absence of a layer of a release agent on the thermoplastic polymer coating, i.e., without having to apply a coating or layer of a release agent to the toner contacting surface of the thermoplastic polymer coating on the receiver substrate prior to contacting the thermoplastic polymer coating with the toner particles on the element surface and transference of the particles to the receiver. Furthermore, by maintaining the temperature of the receiver such that the temperature of the thermoplastic polymer coating is maintained above the Tg of the thermoplastic polymer immediately after transfer while the receiver is separating from the element surface, the receiver will separate readily and easily from the element, while hot, without the thermoplastic polymer coating adhering to the element surface and without the prior application of a release agent to the thermoplastic polymer coating, as previously discussed. In addition, all of the other previously discussed advantages inherent in the use of a thermoplastic polymer coated receiver in a thermally assisted transfer process are preserved by the process of the present invention including the production of copies having a more uniform gloss and images having a less grainy appearance. Still further, it is now possible to determine in advance, in a thermally assisted transfer process, which thermoplastic polymers can be used as receiver coating materials which will not only remove virtually all of the toner particles from the element during transfer but, at the same time, will not adhere to the element during transfer and subsequent separation of the receiver from the element.

Therefore, in accordance with the present invention, there is now provided a method of non-electrostatically transferring dry toner particles which comprise a toner binder and which have a particle size of less than 8 micrometers from the surface of an element which has a surface layer which comprises a film-forming, electrically insulating polyester or polycarbonate thermoplastic polymeric resin matrix and a surface energy of not greater than approximately 47 dynes/cm to a receiver which comprises a substrate having a coating of a thermoplastic polymer on a surface of the substrate wherein the thermoplastic polymer is a thermoplastic condensation polymer having a Tg which is less than approximately 10° C. above the Tg of the toner binder and the surface energy of the thermoplastic polymer coating is approximately 38 to 43 dynes/cm whereby virtually all of the toner particles are transferred from the surface of the element to the thermoplastic polymer coating on the receiver substrate and the thermoplastic polymer coating is prevented from adhering to the surface of the element during transfer and subsequent separation of the receiver from the element in the absence of a layer of a release agent on the thermoplastic polymer coating on the receiver substrate which comprises contacting the toner particles with the thermoplastic polymer coating on the receiver substrate and heating the receiver to a temperature such that the temperature of the thermoplastic polymer coating on the receiver during transfer is at least approximately 5° C. above the Tg of the thermoplastic polymer and thereafter separating the receiver from the element at a temperature above the Tg of the thermoplastic polymer.

DESCRIPTION OF THE PREFERRED EMBODIMENT

In the method of this invention, the transfer of toner particles from the element to the receiver is accomplished non-electrostatically using a receiver which comprises a substrate having a coating of a thermoplastic condensation polymer on a surface of the substrate in which the thermoplastic polymer coating has a surface energy in the range of from approximately 38 to 43 dynes/cm and the Tg of the thermoplastic condensation polymer is less than approximately 10° C. above the Tg of the toner binder. The upper surface, or surface layer, of the element on which the toner particles which are to be transferred are carried, comprises a film-forming, electrically insulating polyester or polycarbonate thermoplastic polymeric binder resin matrix and the surface of the element has a surface energy of not greater than approximately 47 dynes/cm, preferably from about 40 to 45 dynes/cm. The receiver is heated to a temperature such that the temperature of the thermoplastic polymer coating on the receiver substrate during transfer is at least approximately 5° C. above the glass transition temperature, Tg, of the thermoplastic polymer. After transfer, the receiver is immediately separated from the element while the temperature of the receiver is maintained at a temperature which is above the Tg of the thermoplastic polymer. As a result of the unique selection and combination of materials which form the thermoplastic polymer coatings and surface layers of the elements used in the practice of the process of the present invention, the interrelationship of the respective surface energies of the thermoplastic polymer coating and element surface used in the practice of the process of the present invention, and the heating temperatures which are employed during contact of the receiver with the element during toner transfer and during the subsequent separation of the receiver from the element, it is possible to transfer virtually 100% of the toner particles from the element to the receiver using the thermally assisted method of transfer without a coating or a layer of a release agent on the thermoplastic polymer coating in order to prevent the thermoplastic polymer coating from adhering to the element surface during transfer and subsequent separation of the receiver from the element.

The significance of the interrelationship between the polyester and/or polycarbonate materials which form the thermoplastic polymeric binder resin matrices of the surface layers of the elements which are used in the practice of the process of the present invention, the thermoplastic condensation polymers which form the receiver coatings which are used in the practice of the process of the present invention and the respective surface energies of the thermoplastic polymer coatings and the element surface layers to one another to the successful transfer of virtually all of the toner particles from the element to the receiver without the adherence of the thermoplastic polymer coating material to the surface of the element during toner transfer and subsequent separation of the receiver from the element where the receiver is heated to a temperature such that the temperature of the thermoplastic polymer coating on the receiver substrate during transfer is at least approximately 5° C. above the Tg of the thermoplastic polymer and its temperature immediately following transfer during separation of the receiver from the element is maintained above the Tg of the thermoplastic polymer in the absence of a layer or a coating of a release agent on the thermoplastic polymer coating, is demonstrated by the fact that it was found that when receivers were used in the thermally assisted transfer process of the present invention which had a coating of a thermoplastic condensation polymer on a surface of the substrate in which the thermoplastic polymer had a Tg of less than approximately 10° C. above the Tg of the toner binder but the coating had a surface energy which was greater than approximately 43 dynes/cm, the receiver failed to separate while hot from an element having the aforedefined characteristics and properties during transfer immediately upon exiting the transfer nip. However, when receivers were used in the thermally assisted transfer process of the present invention which had a coating of a thermoplastic condensation polymer on a surface of the substrate in which the thermoplastic polymer had a Tg of less than approximately 10° C. above the Tg of the toner binder and the polymer coating had a surface energy which was in a range of from approximately 38 to 43 dynes/cm, the receiver did not adhere to the element during transfer and separated readily from the element after transfer (i.e., did not adhere or stick to the element) and allowed virtually 100% transfer of the toner particles from the element to the receiver. Further, when a receiver is used in the thermally assisted transfer process of the present invention which has a coating of a thermoplastic condensation polymer on a surface of the substrate in which the thermoplastic polymer has a Tg of less than approximately 10° C. above the Tg of the toner binder and the polymer coating has a surface energy which is less than approximately 38 dynes/cm, the receiver will readily separate from such an element during transfer immediately upon exiting the transfer nip and not adhere to the element, but will exhibit unacceptable transfer efficiencies.

The present invention constitutes an improvement in the thermally assisted method of non-electrostatically transferring very small toner particles from the surface of an element to a thermoplastic polymer coated receiver where the toner particles which are carried on the surface of the element are transferred non-electrostatically to the receiver which is heated, but not heated sufficiently to melt the particles. As is taught in previously mentioned U.S. application Ser. No. 230,381 entitled "Improved Method of Non-Electrostatically Transferring Toner" filed Aug. 9, 1988, it is not necessary or desirable to melt the toner particles in order to achieve their transfer, but that merely fusing the toner particles to each other at their points of contact, i.e. localized regions on the individual toner particle surfaces which are in contact either with one another or with the surface upon which such a particle is transferred or deposited, is adequate to accomplish a complete, or nearly complete, transfer of the particles. Thus, the toner is not fixed during transfer, but instead is fixed at a separate location away from the element. In this manner, the higher temperatures required for fixing the toner do not negatively affect or damage the element. Since the heat required to merely sinter the toner particles at their points of contact is much lower than the heat needed to fix the toner, the element is not damaged by high temperatures during transfer.

The term "sinter" or "sintering" as used herein in relation to toner particles employed in the practice of the present invention has reference to bonding or fusion that is thermally achieved at locations of contact existing either between adjacent toner particles or between toner particles and an adjacent surface. The term "sinter" and equivalent forms is distinguished for present purposes from a term such as "melts", "melting", "melt", "melt fusion" or "heat fusion". In heat fusion, in response to sufficiently applied thermal energy, toner particles tend to lose their discrete individual identities and melt and blend together into a localized mass, as when a toner powder is heat fused and thereby bonded or fixed to a receiver.

The crux of the present invention resides in the fact that it has now been found that very fine toner particles, i.e. toner particles having a particle size of less than 8 micrometers, and more typically, 3 to 5 micrometers, can be non-electrostatically transferred with virtually 100% transfer efficiency from the surface of an element to the surface of a thermoplastic polymer coated receiver using the thermally assisted method of transfer, but without the necessity of having to apply a coating or a layer of a release agent to the thermoplastic polymer coating prior to toner transfer in order to prevent the thermoplastic polymer coating from adhering to the element surface during and immediately following toner transfer when the receiver separates from the element. This is primarily thought to be the result of the interrelationship between the unique selection and combination of materials which form the thermoplastic polymer coatings, the materials which comprise the thermoplastic binder resin matrices of the surface layers of the elements which are used in the thermally assisted transfer process of the present invention, the interrelationship which exists between the respective surface energies of the thermoplastic polymer coatings and the surface layers of the elements used in the thermally assisted transfer process of the present invention to each other, and the heating temperatures employed during contact of the thermoplastic polymer coated receiver with the element surface during toner transfer and subsequent separation of the receiver from the element.

Almost any type of substrate can be used to make the coated receiver used in this invention, including paper, film, and particularly transparent film, which is useful in making transparencies. The substrate must not melt, soften, or otherwise lose its mechanical integrity during transfer or fixing of the toner. A good substrate should not absorb the thermoplastic polymer, but should permit the thermoplastic polymer to stay on its surface and form a good bond to the surface. Substrates having smooth surfaces will, of course, result in a better image quality. A flexible substrate is particularly desirable, or even necessary, in many electrostatographic copy machines. A substrate is required in this invention because the thermoplastic coating must soften during transfer and fixing of the toner particles to the receiver, and without a substrate the thermoplastic coating would warp or otherwise distort, or form droplets, destroying the image.

Any good film-forming thermoplastic condensation polymer can be used in the practice of the present invention to form a thermoplastic polymer coating on the substrate provided that it has a glass transition temperature or Tg which is less than approximately 10° C. above the Tg of the toner binder and provides a thermoplastic polymer coating which has a surface energy of from about 38 to about 43 dynes/cm.

The term "glass transition temperature" or "Tg" as used herein means the temperature or temperature range at which a polymer changes from a solid to a viscous liquid or rubbery state. This temperature (Tg) can be measured by differential thermal analysis as disclosed in Mott, N. F. and Davis, E. A. *Electronic Processes in Non-Crystalline Material.* Belfast, Oxford University Press, 1971. p. 192.

The term "surface energy" of a material as used herein means the energy needed or required to create a unit surface area of that material to an air interface. Surface energy can be measured by determining the contact angles of droplets of two different liquids, e.g., diiodomethane and distilled water on the surface of the material and adding the polar and dispersive contributions to the surface and by using the approximation of Girifalco and Good for the interfacial energy as described in Fowkes, F. "Contact Angle, Wettability, and Adhesion". in: *Advances in Chemistry Series* (Washington, D. C., American Chemical Society, 1964) p. 99–111.

A preferred weight average molecular weight for the thermoplastic condensation polymer is about 20,000 to about 500,000. An especially preferred weight average molecular weight is about 20,000 to about 80,000. In general, lower molecular weight polymers may have poorer physical properties and may be brittle and crack, and higher molecular weight polymers may have poor flow characteristics and do not offer any significant additional benefits for the additional expense incurred. In addition to the foregoing requirements, the thermoplastic condensation polymer must be sufficiently adherent to the substrate so that it will not peel off when the receiver is heated. It must also be sufficiently adherent to the toner so that transfer of the toner occurs. The thermoplastic polymer coating also should be abrasion resistant and flexible enough so that it will not crack when the receiver is bent. A good thermoplastic polymer should not shrink or expand very much, so that it does not warp the receiver or distort the image, and it is preferably transparent so that it does not detract from the clarity of the image.

The thermoplastic condensation polymer advantageously should have a Tg that is less than approximately 10° C. above the Tg of the toner binder, which preferably has a Tg of about 50 to about 100° C., so that the toner particles can be pressed into the surface of the thermoplastic polymer coating during transfer thereby becoming slightly or partially embedded therein, in contrast to being completely or nearly completely encapsulated in the thermoplastic polymer coating. Preferably, the Tg of the thermoplastic condensation polymer is below the Tg of the toner binder, but polymers having a Tg up to approximately 10° C. above the Tg of the toner binder can be used at higher nip speeds when the toner is removed from the nip before it can melt. Melting of the toner in the nip should be avoided as it may cause the toner to adhere to the element or to damage the element. Since fixing of the toner on the receiver usually requires the fusing of the toner, fixing occurs at a higher temperature than transfer and fixing softens or melts both the toner and the thermoplastic polymer coating. A suitable Tg for the polymer is about 40 to about 80° C., and preferably about 45 to about 60° C., as polymers having a lower Tg may be too soft in warm weather and may clump or stick together, and polymers having a higher Tg may not soften enough to pick up all of the toner. Other desirable properties include thermal stability and resistance to air oxidation and discoloration.

Examples of preferred thermoplastic condensation polymers which can be used in the practice of this invention include:

(a) polyesters prepared from units derived from at least one dicarboxylic acid component and at least one diol component wherein said dicarboxylic acid component is selected from the group consisting of an aromatic dicarboxylic acid component wherein said aromatic dicarboxylic acid component is a terephthalic acid component, an isophthalic acid component or a naphthalene dicarboxylic acid component; a linear aliphatic dicarboxylic acid component having the formula:

$$HO_2C—R—CO_2H$$

wherein R is an alkyl group or an alkylene group having from 2 to about 20 carbon atoms; or a cycloaliphatic dicarboxylic acid component having the formula:

$$HO_2C—R_1—CO_2H$$

wherein $R_1$ is a cycloaliphatic group having from 4 to 6 carbon atoms, and said diol component is a symmetrical linear alkylene diol having the formulas:

$$HO—CH_2—R_3—OH \quad (I)$$

$$HO—R_4—X—R_4—OH \quad (II)$$

wherein $R_3$ is an alkylene group having from 1 to about 9 carbon atoms and $R_4$ is an alkylene group having from 2 to about 7 carbon atoms, and X is oxygen or sulfur, and (b) polyester copolymers prepared from units derived from at least one dicarboxylic acid component and at least one diol component, at least one of said acid or said diol components being a mixture of at least two different acids or two different diols, respectively, so that a copolymer is obtained, and at least one of said acid components is selected from the group of acid components as defined above and at least one of said diol components is selected from the group of said diol components as defined above.

The aromatic dicarboxylic acid component used to prepare the polyesters employed in the invention is isophthalic acid, terephthalic acid, or naphthalene dicarboxylic acid or the polyesterfiable derivatives thereof including the corresponding esters derived from said acids, for example, diethylisophthalate and dimethylterephthalate and their corresponding acid anhydrides and acid chlorides. A particularly useful dicarboxylic acid component employed in the invention is terephthalic acid and polyesterfiable derivatives thereof.

The linear aliphatic dicarboxylic acid component used to prepare the polyesters employed in the invention are linear aliphatic dicarboxylic acid components having the formula:

$$HO_2—C—R—CO_2—H$$

wherein R is an alkyl group or an alkylene group having from 2 to about 20 carbon atoms or the polyesterifiable derivatives thereof including the corresponding esters derived from said acids and their corresponding acid anhydrides and acid chlorides. Particularly useful linear aliphatic dicarboxylic acid components are diethyl succinate, dimethyl adipate and dimethyl cinnimate.

The cycloaliphatic dicarboxylic acid component used to prepare the polyesters employed in the invention are cycloaliphatic dicarboxylic acid components having the formula:

$$HO_2C—R_1—CO_2H$$

wherein $R_1$ is a cycloaliphatic group having from 4 to 6 carbon atoms or the polyesterifiable derivatives thereof including the corresponding esters derived from said acids and their corresponding acid anhydrides and acid chlorides. Specific examples of such cycloaliphatic groups include cyclobutylene, cyclopentylene and cyclohexylene.

Specific examples of the various symmetrical linear straight chain alkylene diol materials useful in preparing the polyesters employed in the present invention include ethylene glycol, diethylene glycol, trimethylene glycol, tetramethylene glycol, pentamethylene glycol, and the like.

Examples of especially preferred thermoplastic condensation polymers which can be used in the practice of this invention include copolymers formed from the esterification of dimethyl terephthalate with a symmetrical lower alkylene diol selected from the group consisting of ethylene glycol, 1,4-butanediol, 1,6-hexanediol and 2,2'-oxydiethanol. A most preferred copolymer is poly(2,2-oxydiethylene-co-ethylene terephthalate) which is available commercially from Eastman Kodak Company under the tradename Kodabond TM. Additional examples include poly(butylene-cyclohexanoate-co-terephthalate) and poly(butylene-co-hexamethylene-isophthalate-co-terephthalate).

The specific thermoplastic condensation polymers employed in the present invention are known materials and therefore a detailed discussion of various methods of their preparation is unnecessary herein.

The thermoplastic coating on the receiver can be formed in a variety of ways, including solvent coating, extruding, and spreading from a water latex. The resulting thermoplastic polymer coating on the substrate is preferably about 5 to about 30 micrometers in thickness, and more preferably about 2 to about 20 micrometers in thickness, as thinner layers may be insufficient to transfer all of the toner from the element and thicker layers are unnecessary and may result in warpage of the receiver, may tend to delaminate, may embrittle, or may result in a loss of image sharpness.

As mentioned previously, one of the criteria to the successful practice of the process of the present invention is that the surface energies of the thermoplastic polymer coatings on the receiver substrates used in the process of the invention be in a range of from approximately 38 to 43 dynes/cm. In general, thermoplastic polymer coatings which meet this requirement can be attained by selecting, as thermoplastic condensation polymers for forming the thermoplastic polymer coatings on the receiver substrates, thermoplastic condensation polymers which have a glass transition temperature or Tg that is less than approximately 10° C. above the Tg of the toner binder and a surface energy of from approximately 38 to 43 dynes/cm. In most instances, or generally, this will provide a thermoplastic polymer coated receiver which will have a polymer coating which has the requisite surface energy (i.e., from approximately 38 to 43 dynes/cm). However, it may sometimes happen that when a thermoplastic condensation polymer possessing the required glass transition temperature and surface energy is formed on the substrate, a thermoplastic polymer coated receiver may be produced which has a surface energy which is either somewhat greater than approximately 43 dynes/cm or somewhat less than approximately 38 dynes/cm due to a change in surface energy brought about during the application of the polymer onto the substrate, particularly in those instances where the polymer has been melt extruded onto the substrate. While the cause of this change in surface energy is not completely understood at this time, in the situation where the polymer is melt extruded onto the substrate, it is primarily believed to be due to a thermal degradation of the polymer during the melt extrusion process and changes in the degree of crystallinity as the polymeric material cools through its melting point. Therefore, it is recommended that the surface energy for any given thermoplastic polymer coated receiver which is to be used in the practice of the present process be determined or measured using the above mentioned contact angle procedure prior to using it in carrying out the process of the present invention.

As was stated previously, in the past a layer or a coating of a release agent was formed on the thermoplastic polymer coating of a coated receiver which was used in a thermally assisted transfer process to prevent the thermoplastic polymer coating from adhering or sticking to the element surface during toner transfer and subsequent separation of the thermoplastic polymer coated receiver from the element.

The term "release agent" as used herein has reference to a coatable material or substance which, when present at the time when two surfaces are contacted together, either prevents bonding or sticking from occurring between such surfaces or, if bonding does occur, causes a bond of such a low strength to result that the two surfaces can subsequently be separated without leaving any substantial fragments of one surface embedded in the other. Examples of suitable compounds or substances which were heretofore used as release agents to form a layer or coating of a release agent on such thermoplastic polymer coated receivers include non-polar compounds such as metal salts of organic fatty acids, for example, zinc stearate, nickel stearate and zinc palmitate, siloxane copolymers such as poly[4,4'-isopropylidenediphenylene-co-block-poly(dimethylsiloxanediyl)]sebacate, fluorinated hydrocarbons, perfluorinated polyolefins, and the like.

The layer of release agent was formed on the thermoplastic polymer layer or coating by solvent coating, rubbing on a powdered or liquid release agent, or other method. A preferred method was to apply both the release agent and the thermoplastic polymer together to the substrate. This was done by dissolving both the thermoplastic polymer and the release agent in a suitable non-polar solvent. If the release agent had a lower surface energy than the thermoplastic polymer, the release agent came to the surface of the thermoplastic polymer coating as the solvent evaporated. A solution where the release agent was present in concentrations of from about 1 to about 5% by weight of the combined weight of the thermoplastic polymer and the release agent was typically used. However, formation of the layer of release agent could also be accomplished by mixing the release agent into a melt with the thermoplastic polymer and extruding the melt directly onto the substrate. Such a melt might comprise from about 1 to about 5% by weight of the release agent and from about 95 to about 99% by weight of the thermoplastic polymer. As the melt solidified on the substrate, the release agent came to the surface because the release agent had a lower surface energy than that of the thermoplastic polymer and a layer of the release agent was thus formed on the surface of the thermoplastic polymer coating or layer. A release agent was selected which not only had a surface energy which was lower than the surface energy of the thermoplastic polymer coating to which it was applied, but one which also had a surface energy which was less than the surface energy of the element surface on which the toner particles were carried. Typically, a release agent was selected which had a surface energy of less than 40 dynes/cm to insure that the release agent would have a surface energy which was less than both the thermoplastic polymer coating and the element surface. Because the surface energy of the release agent was lower than both that of the thermoplastic polymer coating and the element surface, the release agent was able to form an interface between the surface of the element and the thermoplastic polymer coating which prevented contact or intimate contact between the surface of the element and the polymer coating and thereby prevented the thermoplastic polymer coating from adhering or sticking to the element surface during toner transfer and during the subsequent separation of the receiver from the element. Thus, the thermoplastic polymer coating was prevented from adhering to the element surface during transfer and separation. If the release layer was applied over the thermoplastic coating it was preferably about 30 Å to about 1 micrometer thick because thinner layers might not prevent the thermoplastic coating from adhering to the element, and the toner may not penetrate into the thermoplastic coating if the layer was thicker.

If desired, coating aids, such as polymethylphenylsiloxane having a methyl to phenyl ratio of 23:1 sold by Dow-Corning Company under the trade designation "DC 510", which is a surfactant, can be added to the thermoplastic polymer coating materials used in the practice of the present invention to facilitate a more uniform coating of the polymer onto the substrate. This can be done, for example, by dissolving both the thermoplastic condensation polymer and the coating aid in a non-polar solvent, coating the polymer and coating aid containing solvent solution onto the surface of the substrate, and thereafter evaporating the solvent from the receiver, or by mixing the coating aid into a melt with the thermoplastic polymer and extruding the melt directly onto the surface of the substrate. Other materials which may be used as coating aids in the practice of the present invention, in addition to the aforedescribed surfactant, can include many of the same substances or compounds which were previously described herein as being suitable release agents for forming a coating or a layer on a thermoplastic polymer coated receiver, e.g., polysiloxanes, metal salts of organic fatty acids, and the like.

However, when such substances or compounds are employed as coating aids in the practice of the present invention, they are used in such small amounts or concentrations that they are precluded from functioning as release agents. For example, if such a material is to be used as a coating aid in the practice of the present invention, it is dissolved in a non-polar solvent along with the thermoplastic polymer coating material in an amount such that the amount of the material present in the solution will be approximately 0.5% by weight of the combined weight of the thermoplastic polymer and the release agent, or less, and preferably from about 0.01 to about 0.05% by weight based on the combined weight of the thermoplastic polymer and the release agent. Likewise, if such a material is to be used as a coating aid in the practice of the present invention and is mixed into a melt with the thermoplastic condensation polymer, the material will be present in the melt in an amount not exceeding approximately 0.5% by weight of the melt, and preferably from about 0.01 to about 0.05% by weight of the melt. In both instances, the concentration of the material in the solution and the melt is not sufficient enough to come to the surface of the thermoplastic polymer coating upon evaporation of the solvent or solidification of the melt and form a continuous layer or coating of the material on the thermoplastic polymer coating surface so as to produce a thermoplastic polymer coating having a layer of a release agent on the polymer coating having a surface energy lower than that of the thermoplastic polymer coating. Thus, the material is precluded from serving as a release agent for the thermoplastic polymer coating as it has generally been found that concentrations of such a material of at least about 1% by weight of the combined weight of the thermoplastic polymer and the material in a solvent solution of the polymer and a concentration of such a material of about 1% by weight of a melt comprising such a material and a thermoplastic polymer is required to form a continuous film or a layer of the material on the surface of the thermoplastic polymer coating upon evaporation of the solvent and solidification of the melt. In no instance, however, will such a compound be present in the thermoplastic polymer coating of a polymer coated receiver used in the practice of the present invention in an amount exceeding approximately 0.5% by weight based on the total weight of the combined thermoplastic polymer coating material and the coating aid material. Thus, although some amount or portion of the coating aid material which is present in the thermoplastic polymer coating may be present at the surface of the thermoplastic polymer coating, it will not be present on the surface of the polymer coating as a continuous film or layer so as to form a layer of a release agent on the polymer coating.

Thus, in accordance with the practice of the process of the present invention, toner particles having a particle size of approximately 8 micrometers or less are non-electrostatically transferred from the surface of an element to a thermoplastic polymer coated receiver using a thermally assisted transfer process in the absence of, or in the substantial absence of, a layer of a release agent on the thermoplastic polymer coating.

Alternatively, the coating aid material can be applied directly to a suitable substrate, such as paper, for example, as by melt extrusion, for example, prior to the formation or application of the thermoplastic polymer coating on the substrate, to form a coating or a layer of the material on the substrate between the substrate and the subsequently applied thermoplastic polymer layer. Coating materials such as polyethylene and polypropylene are examples of suitable materials which can be so applied to the surface of a substrate to facilitate a more uniform coating of the polymer on the receiver substrate. Such materials also serve as sealing layers for the substrate to impart a smooth surface to the substrate in addition to serving as a coating aid for the thermoplastic polymer. In general, the thickness of such a coating on the substrate may range from about 0.0001 to about 30 microns, and preferably from about 5 to about 30 microns.

Extrusion is the preferred method of forming the thermoplastic polymer coating on the receiver substrate. In general, extrusion conditions are determined by the thermal properties of the polymer such as melt viscosity and melting point. In the practice of this invention, one may extrude a molten layer comprised of a thermoplastic addition polymer as above characterized upon one face or surface of a receiver substrate of the type described above using suitable extrusion temperatures. If it is desired to apply a coating aid directly to the substrate prior to applying the thermoplastic polymer coating to the substrate, the coating aid can be melt extruded onto the substrate prior to extruding the thermoplastic polymer onto the substrate, or it can be co-extruded with the polymer.

In the process of this invention, the receiver is preheated to a temperature such that the temperature of the receiver during transfer will be adequate to fuse the toner particles at their points of contact but will not be high enough to melt the toner particles, or to cause contacting toner particles to coalesce or flow together into a single mass. It is important also that the receiver be heated to a temperature such that the temperature of the thermoplastic polymer coating on the substrate is at least approximately 5° C. above the Tg of the thermoplastic polymer during transfer as it has been found that if the temperature of the thermoplastic polymer coating is not maintained at a temperature which is at least about 5° C. above the Tg of the thermoplastic polymer during transfer, less than 50%, and more typically less than 10%, of the toner particles will transfer from the element surface to the thermoplastic polymer coating during transfer. While it is imperative that the receiver be heated to a temperature such that the temperature of the thermoplastic polymer coating will be at least about 5° C. above the Tg of the thermoplastic polymer during transfer, caution must be exercised to make sure that the receiver is not heated to a temperature so high that the toner particles will melt and flow or blend together into a localized mass. In practice, it has generally been found to be prudent not to heat the receiver to a temperature whereby the temperature of the thermoplastic polymer coating during transfer exceeds a temperature which is approximately 25° C. above the Tg of the thermoplastic polymer. This is because the tendency of the thermoplastic polymer coating to adhere to the element surface increases as the temperature of the thermoplastic polymer coating rises above a level which is approximately 25° C. above the Tg of the polymer.

The temperature range necessary to achieve these conditions depends upon the time that the receiver resides in the nip and the heat capacity of the receiver. In most cases, if the temperature of the thermoplastic polymer coating immediately after it contacts the element is below the Tg of the toner binder, but above a temperature that is 20 degrees below that Tg, the toner particles will be fused or sintered at their points of contact and the temperature of the thermoplastic polymer coating will be at a temperature that is approximately at least about 5° C. above the Tg of the thermoplastic condensation polymer. Or, stated another way, if the front surface of the thermoplastic polymer coating on the receiver substrate is preheated to a temperature such that the temperature of the thermoplastic polymer coating is from about 60° to 90° C. when it is in contact with the toner particles on the surface of the element during transfer, the temperature of the thermoplastic polymer coating will be at a temperature that is approximately at least 5° C. above the Tg of the thermoplastic polymer and the toner particles will be fused or sintered at their points of contact during transfer. However, receiver temperatures up to approximately 10° C. above the Tg of the toner binder are tolerable when nip time is small or the heat capacity of the receiver is low. Although either side of the receiver can be heated, it is preferable to conductively heat only the back surface of the receiver, i.e., the substrate surface or side of the receiver which does not contact the toner particles, such as by contacting the substrate with a hot shoe or a heated compression roller, as this is more energy efficient than heating the thermoplastic polymer coating surface of the receiver using a non-conductive source of heat such as, for example, a heat lamp or a plurality of heat lamps, or an oven which results in a less efficient absorption of the heat by the thermoplastic polymer coating. Furthermore, it is easier to control the temperature of that surface, and it usually avoids damage to the receiver. The preheating of the receiver must be accomplished before the heated thermoplastic polymer coating portion of the receiver contacts the element because the length of time during which the receiver is in the nip region when the toner particles are being contacted with the receiver and transferred to the thermoplastic polymer coating on the receiver substrate is so brief (i.e., typically less than 0.25 second, and usually 0.1 second or less), that it would be extremely difficult, if not impossible, to heat the receiver to the temperatures required for the successful transfer of the toner particles to the thermoplastic polymer coating if the receiver was heated only in the nip. Thus, if a backup roller, which presses the receiver against the element, is used to heat the receiver, the receiver must be wrapped around the backup roller sufficiently so that the receiver is heated to the proper temperature before it enters the nip. The backup or compression rollers which can be used in the practice of the process of the present invention to create an appropriate nip for acceptable toner transfer can be hard or compliant (i.e., resilient) rollers.

As with any thermally assisted method of transfer, it has been found that pressure aids in the transfer of the toner to the receiver, and an average nip pressure of about 135 to about 5000 kPa is preferred, as when a roller nip region is used to apply such pressures, or when such pressures are applied by a platen or equivalent. Lower pressures may result in less toner being transferred and higher pressures may damage the element and can cause slippage between the element and the receiver, thereby degrading the image.

As a result of the combination of contact time and temperature, and applied pressure, the toner particles are transferred from the element surface to the adjacent thermoplastic polymer coating surface on the receiver substrate. In all cases, the applied contacting pressure is exerted against the outside face or substrate side of the receiver opposite the thermoplastic polymer coated side or surface of the receiver and the side or face of the element opposite to the element surface on which the toner particles are carried.

Also, as mentioned previously, it is important that the temperature of the receiver be maintained at a temperature which is above the Tg of the thermoplastic polymer during separation of the receiver from the element immediately after the toner particles are transferred to the thermoplastic polymer coating on the receiver so that the receiver will separate from the element while hot without the thermoplastic polymer coating adhering to the element surface during separation.

In any case, the toner must not be fixed during transfer but must be fixed instead at a separate location that is not in contact with the element. In this way, the element is not exposed to high temperatures and the toner is not fused to the element. Also, the use of the lower temperatures during transfer means that the transfer process can be much faster, with 40 meters/minute or more being feasible.

Typically, after transfer of the toner particles from the element to the receiver and subsequent separation of the receiver from the element, the developed toner image is heated to a temperature sufficient to fuse it to the receiver. A present preference is to heat the image-bearing thermoplastic polymer coating surface on the receiver until it reaches or approaches its glass transition temperature and then place it in contact with a heated ferrotyping material which raises the temperature or maintains it above its glass transition temperature while a force is applied which urges the ferrotyping material toward the thermoplastic layer with sufficient pressure to completely or nearly completely embed the toner image in the heated layer. This serves to substantially reduce visible relief in the image and impart a smoothness to the coated layer on the receiver. The ferrotyping material, which conveniently can be in the form of a web or belt, and the receiver sheet can be pressed together by a pair of pressure rollers, at least one of which is heated, to provide substantial pressure in the nip. A pressure of at least approximately 690 kPa should be applied, however, better results are usually achieved with pressures of approximately 2100 kPa, typically in excess of about 6,900 kPa, particularly with multilayer color toner images. The ferrotyping web or belt can be made of a number of materials including both metals and plastics. For example, a highly polished stainless steel belt, as electroformed nickel belts, and a chrome plated brass belt both have good ferrotyping and good release characteristics. In general, better results are obtained, however, with conventional polymeric support materials such as polyester, cellulose acetate and polypropylene webs, typically having a thickness of approximately 2–5 mils. Materials marketed under the trademarks Estar, Mylar and a polyamide film distributed by Dupont under the trademark Kapton-H, which optionally can be coated with a release agent to enhance separation, are especially useful ferrotyping materials. In addition, metal belts coated with heat resistant, low surface energy polymers, such as highly crosslinked polysiloxanes, also are effective ferrotyping materials. After the image-bearing thermoplastic coated surface has been contacted with the ferrotyping material and the toner image has been embedded in the heated thermoplastic coating or layer, the layer is allowed to cool to well below its glass transition temperature while it is still in contact with the ferrotyping material. After cooling, the layer is separated from the ferrotyping material.

Either halftone or continuous tone images can be transferred with equal facility using the process of this invention. Because the electrostatic image on the element is not significantly disturbed during transfer it is possible to make multiple copies from a single imagewise exposure.

Toners useful in the practice of this invention are dry toners having a particle size of less than 8 micrometers, and preferably 5 micrometers or less. The toners must contain a thermoplastic binder in order to be fusible.

The polymers useful as toner binders in the practice of the present invention can be used alone or in combination and include those polymers conventionally employed in electrostatic toners. Useful polymers generally have a Tg of from about 40° to 120° C., preferably from about 50° to 100° C. Preferably, toner particles prepared from these polymers have a relatively high caking temperature, for example, higher than about 60° C., so that the toner powders can be stored for relatively long periods of time at fairly high temperatures without having individual particles agglomerate and clump together. The melting point or temperature of useful polymers preferably is within the range of from about 65° C. to about 200° C. so that the toner particles can readily be fused to the receiver to form a permanent image. Especially preferred polymers are those having a melting point within the range of from about 65° to about 120° C.

Among the various polymers which can be employed in the toner particles of the present invention are polycarbonates, resin-modified maleic alkyd polymers, polyamides, phenol-formaldehyde polymers and various derivatives thereof, polyester condensates, modified alkyd polymers, aromatic polymers containing alternating methylene and aromatic units such as described in U.S. Pat. No. 3,809,554 and fusible crosslinked polymers and described in U.S. Pat. No. Re. 31,072.

Typical useful toner polymers include certain polycarbonates such as those described in U.S. Pat. No. 3,694,359, which include polycarbonate materials containing an alkylidene diarylene moiety in a recurring unit and having from 1 to about 10 carbon atoms in the alkyl moiety. Other useful polymers having the above-described physical properties include polymeric esters of acrylic and methacrylic acid such as poly(alkyl acrylate), and poly(alkyl methacrylate) wherein the alkyl moiety can contain from 1 to about 10 carbon atoms. Additionally, other polyesters having the aforementioned physical properties also are useful. Among such other useful polyesters are copolyesters prepared from terephthalic acid (including substituted terephthalic acid), a bis(hydroxyalkoxy)phenylalkane having from 1 to 4 carbon atoms in the alkoxy radical and from 1 to 10 carbon atoms in the alkane moiety (which also can be a halogen-substituted alkane), and an alkylene glycol having from 1 to 4 carbon atoms in the alkylene moiety.

Other useful polymers are various styrene-containing polymers. Such polymers can comprise, e.g., a polymerized blend of from about 40 to about 100% by weight of styrene, from 0 to about 45% by weight of a lower alkyl acrylate or methacrylate having from 1 to about 4 carbon atoms in the alkyl moiety such as methyl, ethyl, isopropyl, butyl, etc. and from about 5 to about 50% by weight of another vinyl monomer other than styrene, for example, a higher alkyl acrylate or methacrylate having from about 6 to 20 or more carbon atoms in the alkyl group. Typical styrene-containing polymers prepared from a copolymerized blend as described hereinabove are copolymers prepared from a monomeric blend of 40 to 60% by weight styrene or styrene homolog, from about 20 to about 50% by weight of a lower alkyl acrylate or methacrylate and from about 5 to about 30% by weight of a higher alkyl acrylate or methacrylate such as ethylhexyl acrylate (e.g., styrene-butyl acrylate-ethylhexyl acrylate copolymer). Preferred fusible styrene copolymers are those which are covalently crosslinked with a small amount of a divinyl compound such as divinylbenzene. A variety of other useful styrene-containing toner materials are disclosed in U.S. Pat. No. 2,917,460; U.S. Pat. No. Re 25,316; U.S. Pat. Nos. 2,788,288; 2,638,416; 2,618,552 and 2,659,670. Especially preferred toner binders are polymers and copolymers of styrene or a derivative of styrene and an acrylate, preferably butylacrylate.

Useful toner particles can simply comprise the polymeric particles but it is often desirable to incorporate addenda in the toner such as waxes, colorants, release agents, charge control agents, and other toner addenda well known in the art. The toner particle also can incorporate carrier material so as to form what is sometimes referred to as a "single component developer." The toners can also contain magnetizable material, but such toners are not preferred because they are available in only a few colors and it is difficult to make such toners in the small particles sizes required in this invention.

If a colorless image is desired, it is not necessary to add colorant to the toner particles. However, more usually a visibly colored image is desired and suitable colorants selected from a wide variety of dyes and pigments such as disclosed for example, in U.S. Pat. No. Re. 31,072 are used. A particularly useful colorant for toners to be used in black-and-white electrophotographic copying machines is carbon black. Colorants in the amount of about 1 to about 30 percent, by weight, based on the weight of the toner can be used. Often about 8 to 16 percent, by weight, of colorant is employed.

Charge control agents suitable for use in toners are disclosed for example in U.S. Pat. Nos. 3,893,935; 4,079,014; 4,323,634 and British Patent Nos. 1,501,065 and 1,420,839. Charge control agents are generally employed in small quantities such as about 0.01 to about 3, weight percent, often 0.1 to 1.5 weight percent, based on the weight of the toner.

Toners used in this invention can be mixed with a carrier vehicle. The carrier vehicles, which can be used to form suitable developer compositions, can be selected from a variety of materials. Such materials include carrier core particles and core particles overcoated with a thin layer of film-forming resin. Examples of suitable resins are described in U.S. Pat. Nos. 3,547,822; 3,632,512; 3,795,618; 3,898,170; 4,545,060; 4,478,925; 4,076,857; and 3,970,571.

The carrier core particles can comprise conductive, non-conductive, magnetic, or non-magnetic materials, examples of which are disclosed in U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See for example, U.S. Pat. Nos. 4,042,518; 4,478,925; and 4,546,060.

The very small toner particles that are required in this invention can be prepared by a variety of processes well-known to those skilled in the art including spray-drying, grinding, and suspension polymerization.

As indicated above, the process of this invention is applicable to the formation of color copies. If a color copy is to be made, successive latent electrostatic images are formed on the element, each representing a different color, and each image is developed with a toner of a different color and is transferred to a receiver. Typically, but not necessarily, the images will correspond to each of the three primary colors, and black as a fourth color if desired. After each image has been transferred to the receiver, it can be fixed on the receiver, although it is preferable to fix all of the transferred images together in a single step. For example, light reflected from a color photograph to be copied can be passed through a filter before impinging on a charged photoconductor so that the latent electrostatic image on the photoconductor corresponds to the presence of yellow in the photograph. That latent image can be developed with a yellow toner and the developed image can be transferred to a receiver. Light reflected from the photograph can then be passed through another filter to form a latent electrostatic image on the photoconductor which corresponds to the presence of magenta in the photograph, and that latent image can then be developed with a magenta toner which can be transferred to the same receiver. The process can be repeated for cyan (and black, if desired) and then all of the toners on the receiver can be fixed in a single step.

The image-bearing element from which the toner particles are transferred upon contact with the thermoplastic polymer coated receiver sheet of the invention can include any of the electrostatographic elements well known in the art, including electrophotographic or dielectric elements such as dielectric recording elements, and the like with the proviso that the toner contacting surface layer of the element, i.e., the surface layer of the element on which the toner particles are carried comprises a film-forming, electrically insulating polyester or polycarbonate thermoplastic polymeric binder resin matrix and has a surface energy of not greater than approximately 47 dynes/cm, preferably from about 40 to 45 dynes/cm.

The use of such an element has been found to be essential to the practice of the present process in order to achieve virtually 100 percent transfer of the very small toner particles while at the same time preventing the thermoplastic polymer coated receiver from adhering to the element during transfer and subsequent separation of the receiver from the element without resorting to the use of a release agent coated on or otherwise applied to the thermoplastic polymer coating on the receiver substrate, prior to toner contact and toner transfer.

The image-bearing element can be in the form of a drum, a belt, a sheet or other shape and can be a single use material or a reusable element. Reusable elements are preferred because they are generally less expensive. Of course, reusable elements must be thermally stable at the temperature of transfer.

A present preference is to employ a photoconductive element for the element used in toner particle or toner image transfer. The photoconductive element is preferably conventional in structure, function and operation, such as is used, for example, in a conventional electrophotographic copying apparatus. The element is conventionally imaged. For example, an electrostatic latent image-charge pattern is formed on the photoconductive element which can consist of one or more photoconductive layers deposited on a conductive support. By treating the charge pattern with, or applying thereto, a dry developer containing charged toner particles, the latent image is developed. The toner pattern is then transferred to a receiver in accordance with the practice of the present invention and subsequently fused or fixed to the receiver.

Various types of photoconductive elements are known for use in electrophotographic imaging processes. In many conventional elements, the active photoconductive components are contained in a single layer composition. This composition is typically affixed, for example, to a conductive support during the electrophotographic imaging process.

Among the many different kinds of photoconductive compositions which may be employed in the typical single active layer photoconductive elements are inorganic photoconductive materials such as vacuum evaporated selenium, particulate zinc oxide dispersed in a polymeric binder, homogeneous organic photoconductive compositions composed of an organic photoconductor solubilized in a polymeric binder, and the like.

Other useful photoconductive insulating compositions which may be employed in a single active layer photoconductive element are the high-speed heterogeneous or aggregate photoconductive compositions described in U.S. Pat. No. 3,732,180. These aggregate-containing photoconductive compositions have a continuous electrically insulating polymer phase containing a finely-divided, particulate, co-crystalline complex of (i) at least one pyrylium-type dye salt and (ii) at least one polymer having an alkylidene diarylene group in a recurring unit.

In addition to the various single active layer photoconductive insulating elements such as those described above, various "multi-layer" photoconductive insulating elements have been described in the art. These kinds of elements, also referred to as "multi-active" or "multi-active-layer" photoconductive elements, have separate charge generation and charge transport layers as are appreciated by those familiar with the art. The configuration and principles of operation of multi-active photoconductive elements are known as are methods for their preparation having been described in a number of patents, for example, in U.S. Pat. Nos. 4,175,960; 4,111,693; and 4,578,334. Another configuration suitable for the imaging of elements in the practice of the process of the invention is the "inverted multi-layer" form in which a charge-transport layer is coated on the conductive substrate and a charge-generation layer is the surface layer. Examples of inverted multi-layer elements are disclosed, for example, in U.S. Pat. No. 4,175,960.

It should be understood that, in addition to the principal layers which have been discussed, i.e., the conductive substrate and the charge-generation and the charge-transport layers, the photoconductive elements which can be used in the practice of the present invention may also contain other layers of known utility, such as subbing layers to improve adhesion of contiguous layers and barrier layers to serve as an electrical barrier layer between the conductive layer and the photoconductive composition. The charge-generation and charge-transport layers also can contain other addenda such as leveling agents, surfactants and plasticizers to enhance various physical properties. In addition, addenda such as contrast control agents to modify the electrophotographic response of the element can be incorporated in the charge-transport layers.

In all instances, however, it is essential that the surface layer of the electrostatographic element of choice comprise a film-forming, electrically insulating polyester or polycarbonate thermoplastic polymeric binder resin matrix and have a surface energy of not more than about 47 dynes/cm, preferably from about 40–45 dynes/cm. As indicated above, the surface energy of the element surface can be readily and easily determined or measured by one skilled in the art using the contact angle procedure disclosed in the aforementioned Fowkes, F. "Contact Angle, Wettability, and Adhesion." in: *Advances in Chemical Series* (Washington, D.C., American Chemical Society, 1964) p. 99–111.

Examples of suitable polymers are the condensation polymers of polyester or polycarbonate resins which may comprise the surface layer of the electrostatographic elements which can be used in the process of the present invention include poly[4,4'-2-(norbornylidene)bis-phenoxy azelate-co-terephthalate] and poly[4,4'-(2-isopropylidene)bisphenoxy carbonate].

Examples of other useful polyester and/or polycarbonate binder resins which may be suitable for use in the present invention, include those disclosed in U.S. Pat. Nos. 4,284,699, 4,175,960; 3,615,414; 4,350,751; 3,679,407; 3,684,502; and 3,873,311.

However, since the surface energy of the toner particle carrying surface of the element is largely, if not completely or nearly completely determined by the surface energy of the thermoplastic polyester or polycarbonate materials which comprise the thermoplastic binder resin matrices of the surface layers of the elements used in the practice of the process of the present invention, it is important that the polyester and/or polycarbonate binder resins which comprise the thermoplastic binder resin matrices of the surface layers of the element used in the practice of the present invention have a surface energy not exceeding approximately 47 dynes/cm, and preferably from about 40 to about 45 dynes/cm.

A presently preferred photoconductive element is a near infrared sensitive inverted multi-layer photoconductive element made from fluorine-substituted titanyl tetrafluorophthalocyanine pigments which is disclosed in U.S. Pat. No. 4,701,396.

The invention is illustrated by the following examples.

In these examples, transfer was accomplished by simultaneously passing a thermoplastic polymeric coated receiver and an element, the surface of which had thereon a transferable toner image comprised of very fine toner particles through the nip region of a pair of hard compression rollers which were oppositely rotating with respect to each other, whereby the thermoplastic polymer coating on the receiver was contacted against the toner particles on the element surface while the thermoplastic polymer coating on the receiver was heated to a temperature sufficient to sinter the toner particles at their locations of contact to each other. Heating of the receiver was accomplished by heating the roller contacting the opposed face of the thermoplastic polymer coating, i.e., the substrate face or side of the receiver. The other roller, which contacted the opposed face of the element surface, i.e., the face or side of the element on which the toner particles were not carried, was at ambient temperature (i.e., temperatures usually in the range of about 20° to about 30° C.). Suitable contacting pressures were applied to the compression rollers during contact of the element and the receiver as they passed through the nip region created by the rollers.

In these examples, the contacting pressures were applied to the compression rollers by means of two piston shafts in contact with and driving the unheated roller against the heated roller. The pressures are expressed as air pressures rather than nip pressures. Air pressures are a more precisely determined quantity and are scaled linearly to the nip pressure.

EXAMPLE 1

A receiver suitable for use in the practice of the present invention was prepared as follows. A thermoplastic condensation polymer comprising a commercially available polyester having a Tg of approximately 58° C. and a weight average molecular weight of 70,000 marketed under the name "Kodabond 5116" by Eastman Kodak Company was co-extruded with polyethylene onto a paper substrate by melt extrusion using an Eagan Extruder to form a coating on the receiver substrate having a total thickness of approximately 10–15 microns. The thermoplastic polymer coating on the receiver had a surface energy of approximately 41 dynes/cm.

An electrostatic latent image of a black and white silver halide negative, consisting of both continuous tone and alpha-numeric regions, was formed by standard electrophotographic techniques on the surface of an inverted multilayer photoconductive element which had a toner contacting surface comprising a polycarbonate binder resin of poly(oxycarbonyloxy-1,4-phenylenebicyclo[2.3.1]hept-2-ylidene-1,4-phenylene) and a surface energy of approximately 43 dynes/cm, developed and transferred to the receiver using the thermally assisted transfer method of the present invention. The electrostatic image was developed with a dry electrographic toner in combination with a magnetic carrier consisting of a polymer coated ferrite core material approximately 30 micrometers in diameter. The toner particles were comprised of a polystyrene binder having a Tg of approximately 62° C., marketed as "Piccotoner 1221" by Hercules, and contained 8.0 weight percent carbon black marketed by Cabot Corporation as "Sterling R" and 0.2 weight percent of a quaternary ammonium charge control agent sold by Onyx Chemical Company as "Ammonyx 4002". The toner particles had a median volume weighted diameter of approximately 4.5 micrometers. Transfer was accomplished by passage through the nip region of a pair of compression rollers. The roller contacting the substrate side or face of the receiver opposite the thermoplastic polymer coated side or face of the receiver was heated to a temperature of approximately 100° C. while the other roller which contacted the face or side of the element opposite the element surface on which the toner particles were carried was at ambient temperature so that the front surface of the receiver, i.e., the thermoplastic polymer coating was heated to a temperature that was about 100° C. prior to transfer. The temperature of the thermoplastic polymer coating during transfer was approximately 65° C. The passage speed was 1.25 cm/second. Air pressure to the unheated compression roller was approximately 276 kPa. During passage through the nip region of the rollers, the heated front surface of the receiver, i.e. the thermoplastic polymer coating, was contacted with the toner particles on the surface of the photoconductive element and the particles transferred to the receiver. The receiver and the photoconductive element were separated immediately after transfer while hot and prior to fixing the transferred image. After transfer, the toner image was ferrotyped by casting it against a sheet of Kapton-H and passing the thermoplastic polymer coated receiver bearing the transferred toner image partially embedded in the surface thereof and the Kapton-H through a pair of hard compression rollers oppositely rotating with respect to each other one of which was heated to a temperature of 120° C. and the other being unheated. The ferrotyping sheet contacted the heated roller. The process speed was approximately 0.5 cm/second.

Transfer was excellent and the element readily separated from the receiver after the transfer process was completed. The transfer efficiency, i.e. the percentage of toner that transferred from the element to the receiver, was greater than 99.9 percent. No damage to either the photoconductor or the receiver was observed.

Substantially the same results can be obtained when a photoconductive element which has a toner contacting surface comprising a polyester or a substituted polyester binder resin such as poly[4,4'-(2-norbornylidene)bisphenoxy azelate-co-terephthalate] is substituted for the photoconductive element used in Example 1 and the process of Example 1 is carried out.

EXAMPLE 2

Example 1 was repeated except that the extruded coating of the "Kodabond TM 5116" on the receiver substrate had a surface energy of approximately 48 dynes/cm. Upon exiting the nip, it was found that the receiver had stuck to the photoconductor and force had to be applied to effect separation of the receiver from the element. This resulted in causing numerous cracks to appear in the receiver thereby rendering the resulting image transfer unacceptable. This example does not fall within the scope of the invention because the surface energy of the thermoplastic polymer coating was too high (i.e. less than approximately 43 dynes/cm).

The invention has been described in detail with particular reference to preferred embodiments thereof, but it will be understood that variations and modifications can be effected within the spirit and scope of the invention.

What is claimed is:

1. A method of non-electrostatically transferring dry toner particles which comprise a toner binder and which have a particle size of less than 8 micrometers from the surface of an element which has a surface layer which comprises a film-forming, electrically insulating polyester or polycarbonate thermoplastic polymeric resin matrix and a surface energy of not greater than approximately 47 dynes/cm to a receiver which comprises a substrate having a coating of a thermoplastic condensation polymer on a surface of the substrate wherein the Tg of the thermoplastic polymer is less than approximately 10° C. above the Tg of the toner binder and the surface energy of the thermoplastic polymer coating is approximately 38 to 43 dynes/cm which comprises:

(A) contacting said toner particles with said thermoplastic polymer coating on said receiver;

(B) heating said receiver to a temperature such that the temperature of said thermoplastic polymer coating on said receiver during said transferring is at least approximately 5° C. above the Tg of said thermoplastic polymer; and (C) separating said receiver from said element at a temperature above the Tg of said thermoplastic polymer, whereby virtually all of said toner particles are transferred from the surface of said element to said thermoplastic polymer coating on said receiver.

2. The process of claim 1 wherein said substrate is paper.

3. The process of claim 1 wherein said substrate is a transparent film.

4. The process of claim 1 wherein said substrate is flexible.

5. The process of claim 1 wherein said thermoplastic condensation polymer has a Tg of about 40° C. to about 80° C.

6. The process of claim 1 wherein said thermoplastic condensation polymer has a weight average molecular weight of about 20,000 to about 500,000.

7. The process of claim 1 wherein said thermoplastic condensation polymer is a polyester and is selected from the group consisting of:

(a) polyesters having recurring units derived from at least one dicarboxylic acid component and at least one diol component wherein said dicarboxylic acid component is selected from the group consisting of an aromatic dicarboxylic acid component wherein said aromatic dicarboxylic acid component is a terephthalic acid component, an isophthalic acid component or a naphthalene dicarboxylic acid component; a linear aliphatic dicarboxylic acid component having the formula:

$$HO_2C—R—CO_2H$$

wherein R is an alkyl group or an alkylene group having from 2 to about 20 carbon atoms; or a cycloaliphatic dicarboxylic acid component having the formula:

$$HO_2C—R_1—CO_2H$$

wherein $R_1$ is a cycloaliphatic group having from 4 to 6 carbon atoms, and said diol component is a symmetrical linear alkylene diol having the formulas:

$$HO—CH_2—R_3—OH \quad (I)$$

$$HO—R_4—X—R_4—OH \quad (II)$$

wherein $R_3$ is an alkylene group having from 1 to about 9 carbon atoms and $R_4$ is an alkylene group having from 2 to about 7 carbon atoms, and X is oxygen or sulfur, and (b) polyester copolymers having recurring units derived from at least one dicarboxylic acid component and at least one diol component, at least one of said acid or said diol components being a mixture of at least two different acids or two different diols, respectively, so that a copolyester is obtained, and at least one of said acid components is selected from the group of acid components as defined above and at least one of said diol components is selected from the group of said diol components as defined above.

8. The process of claim 7 wherein said polyester is poly(2,2-oxydiethylene-co-ethylene terephthalate).

9. The process of claim 7 wherein said polyester is poly(butylene-cyclohexanoate-co-terephthalate).

10. The process of claim 7 wherein said polyester is poly(butylene-co-hexamethylene-isophthalate-co-terephthalate).

11. The process of claim 1 wherein said toner binder has a Tg of about 40° C. to about 120° C.

12. The process of claim 11 wherein said toner binder has a Tg of about 50° C. to about 100° C.

13. The process of claim 1 wherein said toner particles are transferred to said receiver from a photoconductive element having a surface layer which comprises a polyester thermoplastic polymeric resin matrix.

14. The process of claim 1 wherein said toner particles are transferred to said receiver from a photoconductive element having a surface layer which comprises a polycarbonate thermoplastic polymeric resin matrix.

15. The process of claim 13 wherein said polyester resin is poly[4,4'-(2-norbornylidene)bisphenoxy azelate-co-terephthalate].

16. The process of claim 14 wherein said polycarbonate resin is poly[4,4'-(2-isopropylidene)bisphenoxy carbonate].

* * * * *